US006264272B1

(12) United States Patent
Jones et al.

(10) Patent No.: US 6,264,272 B1
(45) Date of Patent: Jul. 24, 2001

(54) APPARATUS FOR ERGONOMIC PLACEMENT OF COMPUTER POINTING DEVICE

(76) Inventors: Steven R. Jones, 10415-C San Diego Mission Rd., San Diego, CA (US) 92108; Gerald E. Smith, 8415 La Mesa Blvd., Suite 5-A, La Mesa, CA (US) 91941

( * ) Notice: Subject to any disclaimer, the term of this patent is extended or adjusted under 35 U.S.C. 154(b) by 0 days.

(21) Appl. No.: 09/348,143

(22) Filed: Jul. 6, 1999

(51) Int. Cl.[7] ..... A47B 39/00
(52) U.S. Cl. ..... 297/173; 297/188.18
(58) Field of Search ..... 297/135, 173, 297/188.01, 188.14, 188.15, 188.18, 188.21; 248/118, 349.1, 311.2; 108/6, 50.14, 157.11

(56) References Cited

U.S. PATENT DOCUMENTS

| | | | |
|---|---|---|---|
| 4,815,688 | * | 3/1989 | Wood . |
| 5,048,428 | | 9/1991 | LaRue . |
| 5,169,210 | | 12/1992 | Fricano . |
| 5,234,251 | * | 8/1993 | Ayotte . |
| 5,292,173 | | 3/1994 | Lambert . |
| 5,306,071 | | 4/1994 | Zamo' et al. . |
| 5,474,272 | * | 12/1995 | Thompson et al. . |
| 5,490,710 | * | 2/1996 | Dearing et al. . |
| 5,653,499 | | 8/1997 | Goodall . |
| 5,727,759 | | 3/1998 | Christensen . |
| 5,848,773 | | 12/1998 | Bourassa . |
| 5,887,940 | * | 3/1999 | Anderson et al. . |
| 5,893,607 | | 4/1999 | Trimnell . |
| 5,899,526 | * | 5/1999 | LaPointe et al. . |
| 6,017,085 | * | 1/2000 | LaCroix et al. . |
| 6,027,165 | * | 2/2000 | Adkins . |
| 6,073,997 | * | 6/2000 | Koh . |

* cited by examiner

*Primary Examiner*—Milton Nelson, Jr.
(74) *Attorney, Agent, or Firm*—Steve A. Wong

(57) ABSTRACT

An apparatus for the ergonomic positioning of a computer pointing device comprising a generally planar support member, an armrest attachment member, an adjustable coupling for attaching the support member to the armrest attachment member, and a plurality of straps for mounting the armrest attachment member onto the armrest of a chair. The adjustable coupling provides for rotational positioning of the support member around an axis parallel to the user's line of sight to the monitor, tilt positioning of the support member around an axis perpendicular to the user's axial line of sight to the monitor, and lateral positioning of the support member relative to the armrest attachment member. The armrest attachment member has a generally U-shaped cross-section adapted to fit over the existing armrest of a chair, and the attachment straps, which have Velcro™ fasteners or the like, fasten the armrest attachment member securely onto the armrest.

19 Claims, 5 Drawing Sheets

APPARATUS FOR ERGONOMIC PLACEMENT OF COMPUTER POINTING DEVICE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention pertains generally to computer accessory support structures, and more particularly, to a chair-mounted apparatus for the ergonomically optimum placement of a computer pointing device.

2. Description of the Background Art

With the use of computers becoming almost universal, cumulative trauma disorders that result therefrom have proliferated. This disorder is responsible for a significant amount of lost work time and high labor turnover. The most commonly known cumulative trauma disorder is Carpal Tunnel Syndrome (CTS). CTS occurs when there is an impingement of the median nerve that is located within the wrist caused by excessive stress on joints and tendons. It typically manifests itself with symptoms such as pain, numbness and/or stiffness in the hands, wrist, arm, shoulder and neck. CTS has also been known to cause a loss of range of motion in the shoulder as well as loss of grip strength of the hand. Typically, treatments for CTS may range from noninvasive techniques such as physical therapy that includes joint manipulation, ultrasound, icing and electro-muscle stimulation, to ingestion of anti-inflammatory drugs, and to invasive procedures such as surgery for removing scar tissue within the wrist that impinges the median nerve.

The use of computers have been attributed as the primary cause of CTS. Using computers physically involve repetitive tasks, such as gripping, pushing and reaching for items such as the keyboard and pointing device. This is because the position of the user relative to the keyboard often requires the extension of upper extremities, such as the neck and shoulder, as well as the arms and hands from the seating apparatus to the keyboard. This lack of optimum positioning, coupled with the highly repetitive nature required for keyboard use, results in the aforementioned cumulative trauma injury. The high repetition nature of computer use, along with forceful and awkward postures, exposes the computer user to CTS. To alleviate or eliminate such injuries due to keyboard usage, keyboard drawers or platforms have been developed. The primary object of these devices is to provide an optimum positioning between the user and keyboard, such that the user's upper extremities, arms and hands do not have to extend unnaturally for the prolonged periods of time normally associated with computer usage.

Such known keyboard drawers or platforms, however, are not always effective in preventing cumulative trauma injuries that result from using computer pointing devices, such as a mouse, trackball or touchpad. Use of these computer pointing devices entail repetitive motion of one side of the body extending down from the neck, shoulder, arm, wrist and hand. Keyboard drawers or platforms are typically maintained in a fixed position relative to the computer monitor as opposed to a fixed position relative to the user. Since use of computer pointing devices only involves one hand at a time, having to adjust and position oneself relative to the keyboard drawer or platform is cumbersome and inconvenient. Even if one is able to initially situated herself in a position that optimizes use of the computer pointing device, and viewing of the monitor, having to maintain that position over an extended time will be uncomfortable, thereby, necessitating body movement away from the optimum position. Additionally, the recent rise in popularity of internet usage for activities such as "web surfing", which predominantly requires use of a mouse, has resulted in an increased incidence of cumulative trauma injuries. Chiropractic doctors, who often are called upon to treat cumulative trauma injuries like CTS, have reported that the repetitive motion required for manipulating a mouse, coupled with mouse being placed on a horizontal surface adjacent the keyboard, has accentuated CTS. This fixed positional relationship of the mouse requires unnatural movement of the wrist and arms which result in the aforementioned injuries.

Since excessive stress on joints and tendons is a principle cause of CTS, repetitive motions should be maintained well within the range of motion of that joint. Such activities should ideally be performed with the joints at approximately the midpoint of their range of movement. When force is being applied by the hand, the wrist should be kept straight and the elbow bent at a right angle. All side-to-side deviations of the wrist should be avoided, and the hands should be kept in line with the forearms.

There are devices which have been developed to provide support for a computer pointing device, which help solve the problem of having to maintain the keyboard drawer or platform in a fixed relation to the computer monitor. This is done by attaching the platform to the seating apparatus, thereby maintaining a fixed relation between the user and the pointing device, as opposed to between the pointing device and the monitor.

One such device provides for the attachment of an arm and mouse support platform attached to one side of the seating apparatus. The means for attachment to the seating apparatus, unfortunately, limits its use in an office environment as it must only be attached onto the center column of a chair. Furthermore, the mouse support platform remains fixed relative to the arm support.

Another device which attempts to solve the problem of the repetitive motion of extending and reaching for a computer mouse provides for a plate that is attached onto the armrest of a chair. The plate extends forward of the armrest and is adjustable for wrist supination and pronation by allowing for tilting along an axis parallel to the user's line of sight to the monitor. There is no capability for adjustment of wrist angle, and the device must be affixed to the armrest using bolts, thus limiting its adaptability and portability.

Yet another device which attempts to solve the aforementioned problems associated with cumulative trauma injuries provides for a mouse support pedestal for a mouse platform, in conjunction with opposed clamping mechanisms for attachment onto the armrest of a chair. The platform is linearly adjustable along an axis parallel to the user's line of sight to the monitor, however, it fails to provide for adjustment to accommodate wrist supination or pronation nor wrist tilt angle. Although the armrest attachment mechanism appears to be adaptable to a variety of armrests, its massive opposing clamp approach renders the entire device unwieldy and cumbersome.

It can be seen that the aforementioned devices, as well as the myriad of related devices known in the art, fail to solve all the problems associated with cumulative trauma injuries resulting from use of computer pointing devices. Additionally, these devices have either been too limited to meet all the users needs or are too cumbersome to use or implement, and thus, do not provide enough flexibility for use in an office setting. Therefore, there is a need for a computer pointing device support apparatus that provides for placement of a pointing device, such as a mouse or the like, in a generally fixed position relatively to the user, while also providing for multi-axial adjustability of the support member, as well as universal adaptability to a variety of chairs armrests. The present invention satisfies these needs, as well as others, and generally overcomes the deficiencies found in the background art.

BRIEF SUMMARY OF THE INVENTION

The present invention pertains to apparatus for ergonomically positioning a computer pointing device, such as a mouse, in a generally fixed position relative to a seating apparatus. The apparatus is universally adaptable to armrest chairs and provides for positioning the mouse in an optimum orientation to prevent injuries typically sustained as a result of repetitive motion from use of a computer pointing device.

By way of example and not of limitation, the ergonomic mouse positioning apparatus comprises a generally planar support member, an armrest attachment member, an adjustable coupling for attaching the support member to the armrest attachment member, and a plurality of straps affixed to the armrest attachment member. The planar support member is preferably rectangular-shaped and sized to accommodate a typical mousepad, which may be place or affixed thereon. The adjustable coupling provides for rotational positioning of the support member around an axis parallel to the user's line of sight to the monitor, tilt positioning of the support member around an axis perpendicular to the user's axial line of sight to the monitor, and lateral positioning of the support member relative to the armrest attachment member. The armrest attachment member has a generally U-shaped cross-section adapted to fit over the existing armrest of a chair, and the attachment straps, which have hook and loop fasteners, such as Velcro™ or the like, fasten the armrest attachment member securely onto the armrest. The armrest attachment member further includes at least one attachment screw for attaching the armrest attachment member onto armrest that incapable of accommodating straps. The attachment screw abuts against the side of the armrest thereby clamping the armrest attachment member onto the armrest.

An object of the invention is to provide an apparatus for placing a computer pointing device adjacent an armrest of a seating apparatus.

Another object of the invention is to provide an apparatus for placing a computer pointing device that is positionally adjustable for hand pronation.

Still another object of the invention is to provide an apparatus for placing a computer pointing device that is positionally adjustable for hand tilt.

Still another object of the invention is to provide an apparatus for placing a computer pointing device wherein a the computer pointing device support member is laterally adjustable.

Still another object of the invention is to provide an apparatus for placing a computer pointing device that is attachable to a wide variety of armrests.

Still another object of the invention is to provide an apparatus for placing a computer pointing device that is lightweight and economical.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Referring more specifically to the drawings, for illustrative purposes the present invention is embodied in the apparatus generally shown in FIG. 1 through FIG. 6. It will be appreciated that the apparatus may vary as to configuration and as to details of the parts without departing from the basic concepts as disclosed herein.

Figure 1:
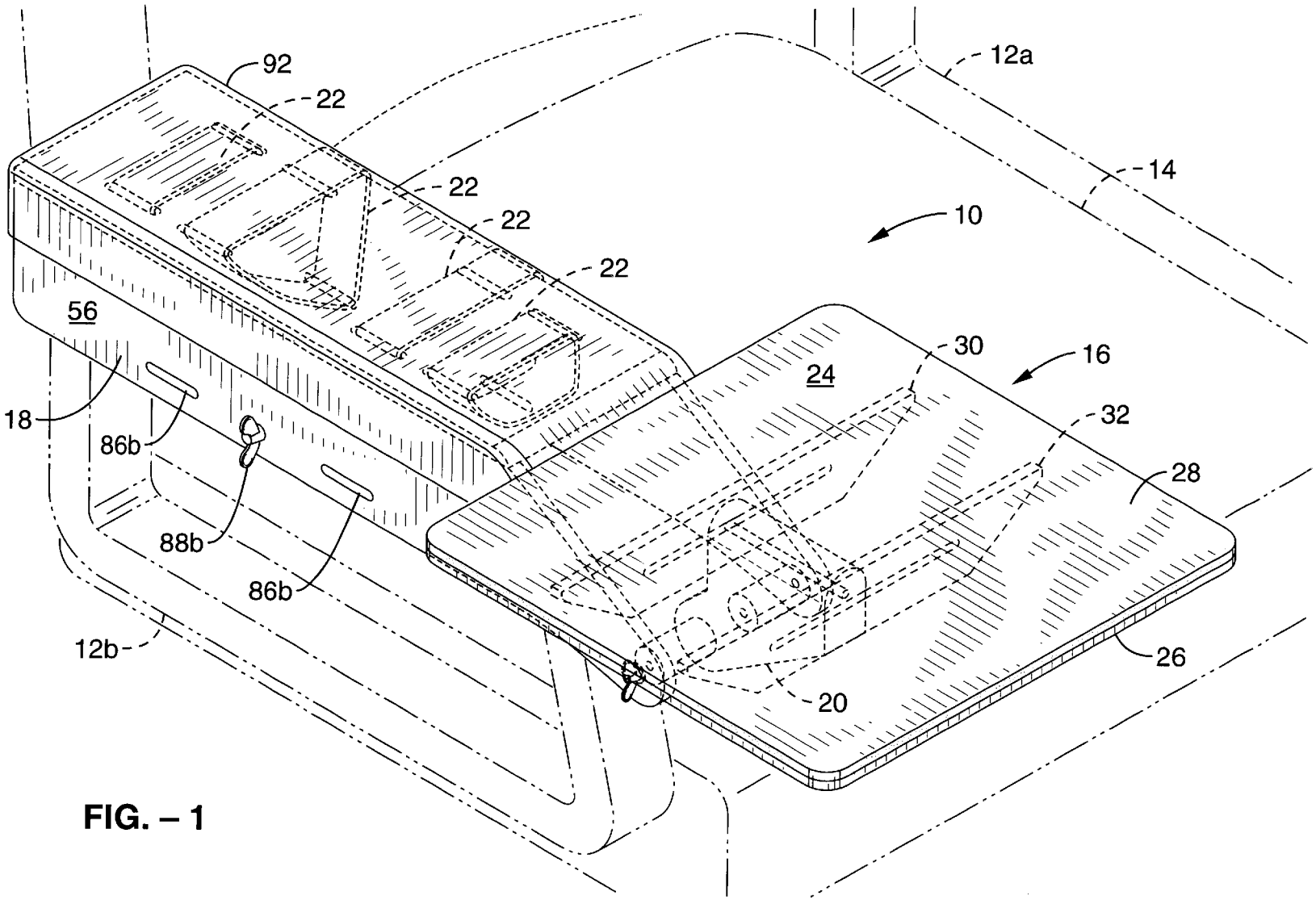
FIG. 1 is a perspective view of a computer pointing device positioning apparatus in accordance with the present invention, shown in conjunction with a chair which is depicted in phantom.

Referring first to FIG. 1, an ergonomic computer pointing device placement apparatus 10 in accordance with the present invention is generally shown. Apparatus 10 is adapted for attachment onto and over the right armrest 12*a* of a chair 14, as shown, for a right-handed user. Alternatively, apparatus 10 may also be attached onto and over the left armrest 12*b* of chair 14, for a left-handed user. As will be seen, apparatus 10 generally comprises a support member 16, an armrest attachment member 18, an adjustable coupling 20, and means 22 for mounting apparatus 10 onto chair 14.

Figure 2A:
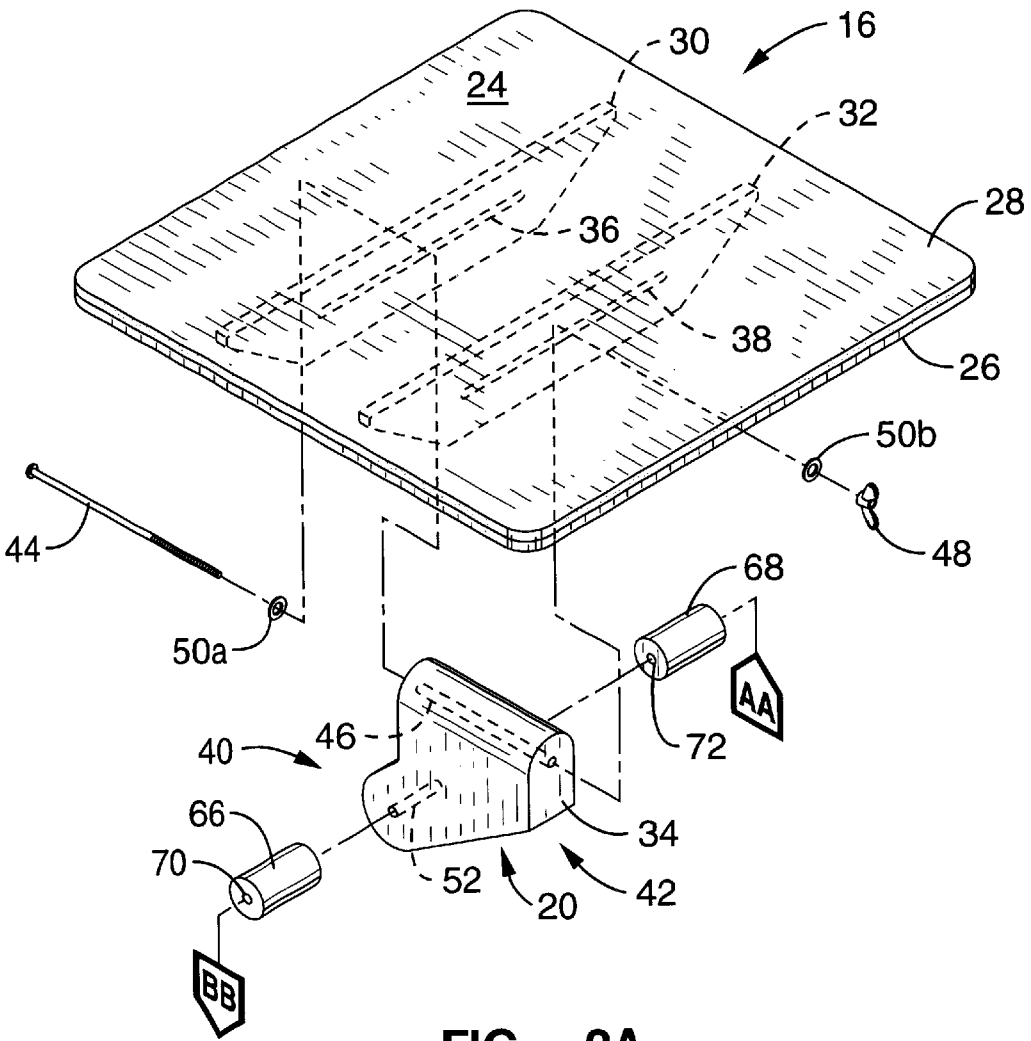
FIG. 2A and FIG. 2B are exploded views of the computer pointing device positioning apparatus shown in FIG. 1.
Figure 2B:
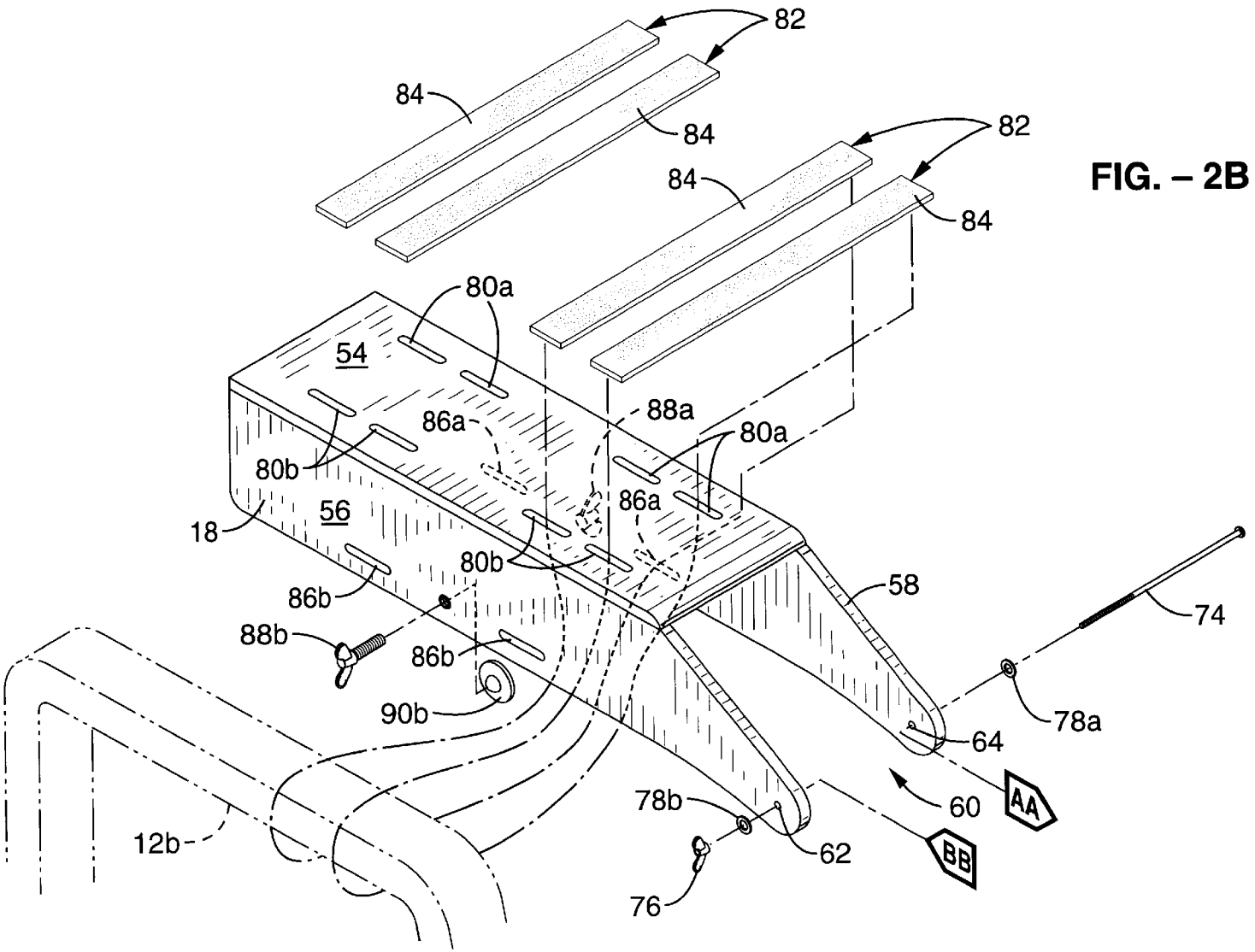

Referring also to FIG. 2A and FIG. 2B, support member 16 includes an upper surface 24 and a lower surface 26. Upper surface 24 is preferably flat so that a computer pointing device (not shown) such as a mouse, trackball, or the like can be placed thereon. Upper surface 24 may also accommodate a mouse pad 28 which may be affixed or merely placed thereon, to improve rolling efficiency of the mouse.

In the preferred configuration, adjustable coupling 20 comprises a plurality of brackets 30 and 32 and a connecting arm 34. Brackets 30 and 32 are disposed on lower surface 26 of support member 16, preferably in a spaced-apart and parallel orientation relative to each other. Brackets 30 and 32 each incorporate an elongated slot 36 and 38, respectively. Connecting arm 34 has a proximate end 40 and a distal end 42. Distal end 42 of connecting arm 34 is positioned between brackets 30 and 32 and secured thereto by a first bolt 44, which passes through elongated slot 36 of bracket 30 and elongated slot 38 of elongated slot 38, as well as through a first bore 46 within connecting arm 34. A wingnut 48, or the like, can be used to maintain compression of brackets 30 and 32 against connecting arm 34. A washer 50*a* is typically placed between first bolt 44 and bracket 30, and another washer 50*b* is placed between bracket 32 and wingnut 48. Connecting arm 34 further includes a second bore 52 disposed adjacent its proximate end 40. Second bore 52 is oriented perpendicular to first bore 46.

Figure 3:
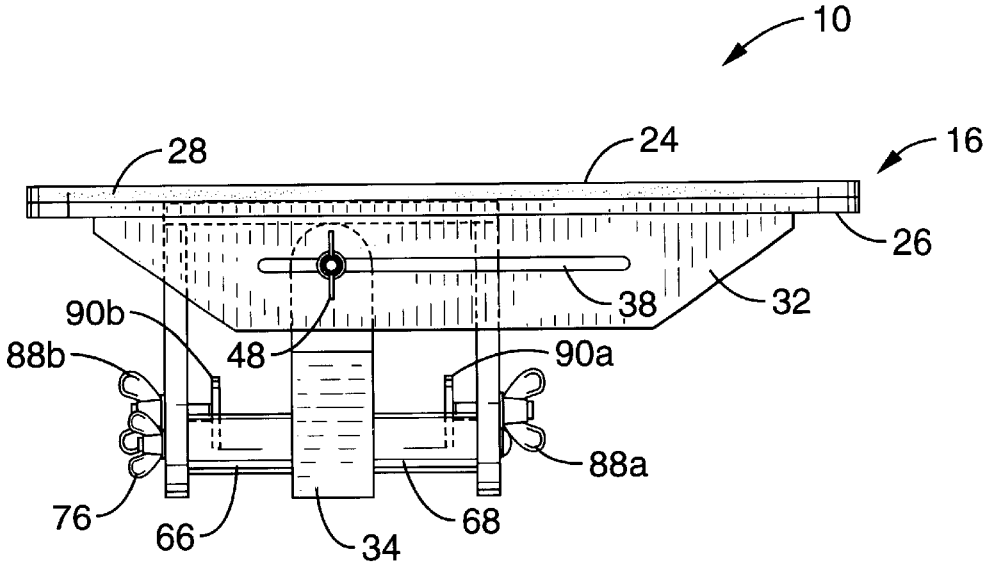
FIG. 3 is an end view of the front of the computer pointing device positioning apparatus shown in FIG. 1.
Figure 4:
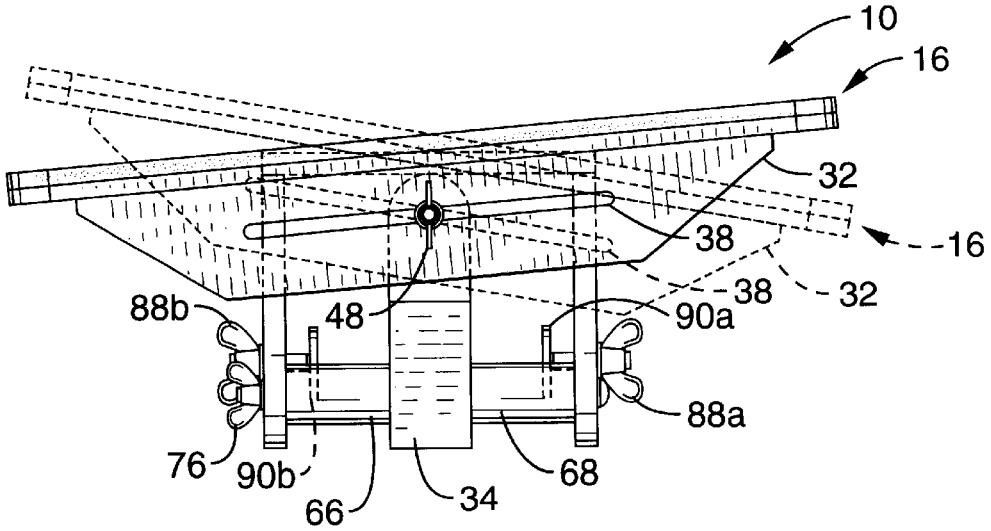
FIG. 4 is an end view of the computer pointing device positioning apparatus shown in FIG. 3 showing a support member tilted along a longitudinal axis.

Referring also to FIG. 3 and FIG. 4, it can therefore be seen that support member 16 is laterally adjustable relative to connecting arm 34 (as shown in FIG. 3), wherein connecting arm 34 can be positioned anywhere along the length of elongated slots 36 and 38. It can also be seen that support member 16 is pivotally adjustable relative to connecting arm 34 (as shown in FIG. 4), thereby allowing for the rotational tilt of support member 16 around the longitudinal axis of armrest attachment member 18 to accommodate the wrist angle of the user. Those skilled in the art will appreciate that a single bracket 30 or 32 may also be used instead of both brackets 30 and 32, as shown and described.

Armrest attachment member 18 comprises a top surface 54 and a pair of lateral surfaces 56 and 58, which are generally parallel to each other and extend downwardly from top surface 54. The separation between lateral surfaces 56 and 58 are such that a wide variety of armrests can be accommodated. Adjacent the forward end 60 of armrest attachment member 18, there are disposed holes 62 and 64 in lateral surfaces 56 and 58, respectively. Proximate end 40 of connecting arm 34 is disposed between lateral surfaces 56 and 58 adjacent forward end 60 of armrest attachment member 18. A pair of spacers 66 and 68 are placed adjacent lateral surfaces 56 and 58, respectively, as well as adjacent each side of connecting arm 34. Spacers 66 and 68 each incorporate a passageway 70 and 72, respectively. A second bolt 74 and wingnut 76 is used to maintain compression and to secure connecting arm 34 onto armrest attachment member 18, wherein second bolt 74 passes through holes 62 and 64 in lateral surfaces 56 and 58, respectively, through passageway 70 and 72 in spacers 66 and 68, respectively, and through second bore 52 of connecting arm 34. A washer 78a is typically placed between second bolt 74 and lateral surface 58, and another washer 78*b* is placed between lateral surface 56 and wingnut 76.

Figure 5:
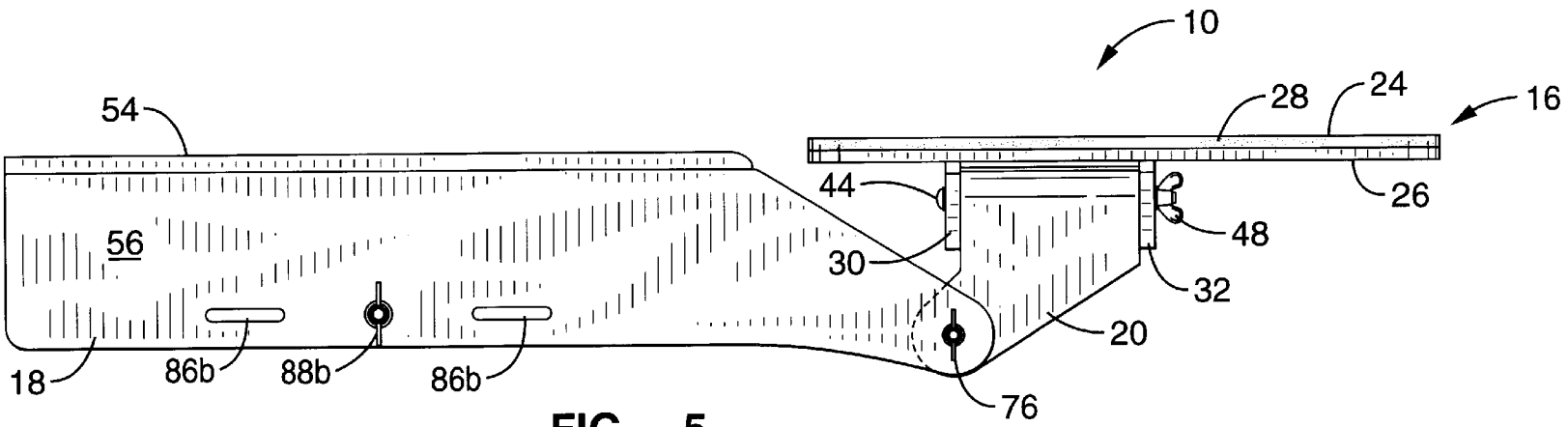
FIG. 5 is a side elevational view the computer pointing device positioning apparatus shown in FIG. 1.
Figure 6:
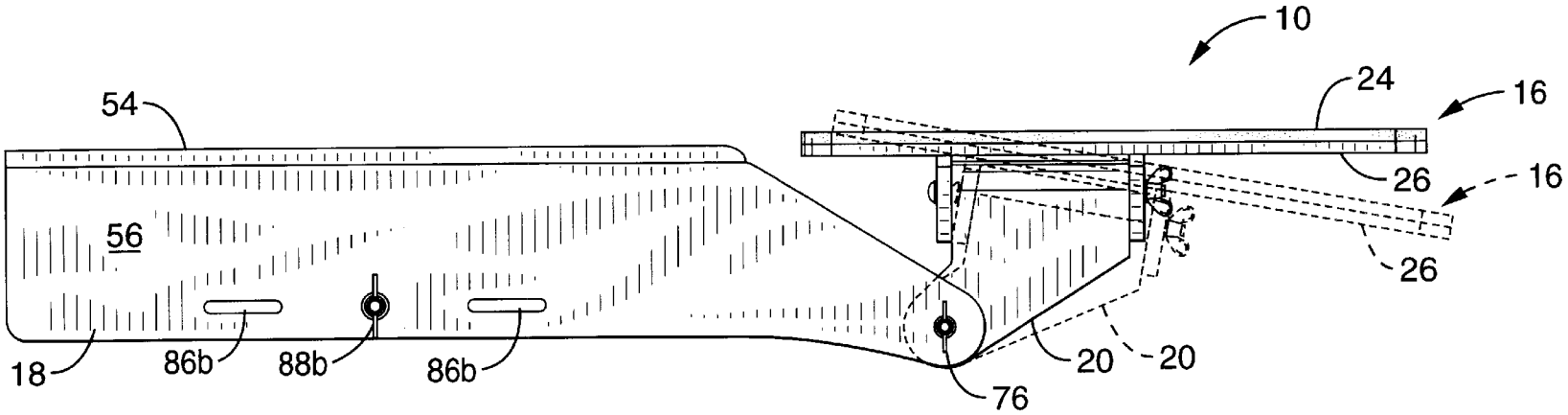
FIG. 6 is a side elevational view the computer pointing device positioning apparatus shown in FIG. 5, showing the support member tilted forwardly along an axis perpendicular to the longitudinal axis.

Referring also to FIG. 5 and FIG. 6, connecting arm 34 can pivot around an axis perpendicular to the longitudinal axis of armrest attachment member 18. It can therefore be seen that support member 16 is adjustable relative to armrest attachment member 18 (as shown in FIG. 6), thereby allowing for the decline or incline of support member 16 relative to armrest attachment member 18 to accommodate the user's wrist angle.

Means 22 for mounting apparatus 10 onto chair 14 generally comprises a plurality of slits 80*a* and 80*b* on top surface 54 of armrest attachment member 18, that are preferably arranged in rows and columns (as shown in FIG. 2B). Slits 80*a* and 80*b* are adapted for receiving a plurality of attachment straps 82, each of which are threaded through a corresponding pair of slits 80*a* and 80*b* (as shown in FIG. 1). Attachment straps 82 provide for the securement of apparatus 10 onto chair 14 by strapping around armrest 12*a* or 12*b*. In order to accomplish this, attachment straps 82 are equipped with fastening means, which may include but is not limited to, hook and loop fasteners 84 (as shown), buckles (not shown), couplings (not shown) and other known means for fastening straps together. Lateral surfaces 56 and 58 of armrest attachment member 18 have lateral slits 86*a* and 86*b* disposed thereon, which allow for straps 84 to be threaded therethrough, if necessary, for better securement of apparatus 10 onto armrest 12*a* or 12*b*. Attachment straps 82 may also have elastic properties which provide for increased versatility in securement of apparatus 10 onto chair 14. It can therefore be seen that means 22 for mounting apparatus 10 onto chair 14 is extremely versatile by allowing for attachment onto armrests having an infinite variety of designs and configurations.

To further increase its adaptability, means 22 for mounting apparatus 10 onto chair 14 further comprises clamping screws 88*a* and 88*b* located on lateral surfaces 56 and 58. Clamping screws 88*a* and 88*b* are threaded through lateral surfaces 56 and 58, respectively, and are typically disposed in an opposing orientation on lateral surface 56 and 58. Clamping screws 88*a* and 88*b* move either towards or away from each other, depending on the direction they are turned. Clamping screws 88*a* and 88*b* are used to secure apparatus 10 onto a solid armrest (not shown), which are not suited for use of attachments straps 84. When clamping screws 88*a* and 88*b* are turned inwardly, they provide compression against the solid armrest to secure apparatus 10 thereto. To better distribute the compressive force against the solid armrest, clamping screws 88*a* and 88*b* incorporate discs or plates 90*a* and 90*b*, respectively, at their distal ends. Those skilled in the art will appreciate that a single clamping screw 88*a* or 88*b* may be used, instead of a pair of opposing clamping screws 88*a* and 88*b*, as shown and described. However, clamping screws 88*a* and 88*b* may nonetheless be also used in conjunction with attachments straps 82 to provide a reinforced attachment onto armrest 12*a* or 12*b*.

It is contemplated that apparatus 10 be fabricated from lightweight, yet durable material, such as wood, plastic, aluminum or the like. The different components that make up apparatus 10 may also be fabricated from a combination of different materials, wherein the objective is to provide for a light, durable and economical product that is easy also to manufacture, assemble, and maintain.

Apparatus 10 is typically used in conjunction with use of a computer having a pointing device. After armrest attachment member 18 is secured onto armrest 12*a* or 12*b* of chair 14, the user may adjust the position of support member 16 for optimum ergonomics. To accommodate the user's wrist tilt angle, the forward tilt of support member 16 is adjusted by first loosening wingnut 76, moving support member 16 to the desired position, then tightening wing nut 76. To accommodate the user's wrist rotation angle, the rotational angle of support member 16 is adjusted by loosening wingnut 48, moving support member 16 to the desired position, then tightening wing nut 48. While wingnut 48 is loose, the user may also adjust the lateral position of support member 16 by moving support member to the left or right, as desired. For increased user comfort, apparatus 10 may include a padding or cushion 92 placed or affixed by any known means over top surface 54, upon which the user's forearm may rest.

Accordingly, it will be seen that this invention provides for a computer pointing device placement apparatus that easily attaches to the armrest of any chair and which also provides the capability for multi-axial adjustment to achieve an ergonomically optimum position for the user's hand and wrist. Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. An ergonomic computer pointing device placement apparatus for attachment onto an armrest of a chair, comprising:

(a) a support member, including an upper surface and a lower surface;

(b) an armrest attachment member having a longitudinal axis;

(c) an adjustable coupling attaching said support member to said armrest attachment member, said adjustable coupling including:

(i) a pivoting axis that is perpendicular horizontally from the longitudinal axis of said armrest attachment member when said support member is in a generally horizontal position;

(ii) a bracket disposed on said lower surface of said support member; and (iii) a connecting arm having a proximate end and a distal end, said distal end pivotally coupled to said bracket of said support member, said proximate end pivotally coupled along said pivoting axis to said armrest attachment member wherein the pivot axis of said distal end is perpendicular to the pivot axis of said proximate end; and (d) means for mounting said armrest attachment member onto the armrest of a chair.

2. An apparatus as recited in claim 1, wherein said bracket further comprises;

(a) a slot laterally disposed herethrough;

(b) a first bolt passing through said distal end of said connecting arm and said slot; and (c) a first nut threaded onto said first bolt, whereby said bracket is secured against said connecting arm.

3. An apparatus as recited in claim 2, further comprising;

(a) a second bolt passing laterally through said attachment member and said proximate end of said connecting arm;

(b) a spacer disposed between said attachment member and said proximate end of said connecting arm; and (c) a second nut threaded into said second bolt, whereby said connecting arm is secured against said spacer.

4. An apparatus as recited in claim 1, wherein said means for mounting said armrest attachment member comprises a plurality of straps extending from said armrest attachment member, said straps adapted to securely fasten said attachment member onto the armrest of a chair.

5. An apparatus as recited in claim 1, wherein said means for mounting said armrest attachment member further comprises at least one set screw.

6. An apparatus as recited in claim 1, further comprising a mousepad affixed onto said upper surface of said support member.

7. An apparatus as recited in claim 1, further comprising padded material disposed on said armrest attachment member.

8. An ergonomic computer pointing device placement apparatus for attachment onto an armrest of a chair, comprising:

(a) an armrest attachment member including an upper surface and a pair of lateral surfaces extending downwardly from said upper surface, said armrest attachment member including a forward end;

(b) a connector arm having a proximate end and a distal end, said proximate end of said connector arm disposed between said pair of lateral surfaces adjacent said forward end;

(c) a first bolt disposed through said pair of lateral surfaces and said proximate end of said connector arm;

(d) a pair of spacers around said first bolt, each said spacer positioned between said connector arm and each said lateral surface;

(e) a pair of brackets, each said bracket including a slot, wherein said distal end of said connector arm disposed between said pair of brackets;

(f) a second bolt disposed through said slots of said brackets and through said distal end of said connector arm, said second bolt oriented perpendicularly to said first bolt;

(g) a support member attached onto said brackets, said support member including an upper surface; and (h) means for mounting said armrest attachment member onto the armrest of a chair.

9. An apparatus as recited in claim 8, wherein said means for mounting said armrest attachment member comprises a plurality of straps adapted to securely fasten said attachment member onto the armrest of a chair.

10. An apparatus as recited in claim 9, wherein said means for mounting said armrest attachment member further comprises a set screw on each said lateral surface, said set screws capable of compressing the armrest of a chair when said armrest attachment member is positioned thereon.

11. An apparatus as recited in claim 8, further comprising a mousepad affixed onto said upper surface of said support member.

12. An apparatus as recited in claim 11, further comprising padded material disposed on said upper surface of said armrest attachment member.

13. An ergonomic computer pointing device placement apparatus for attachment onto an armrest of a chair, comprising:

(a) a support member, including an upper surface and a lower surface;

(b) a pair of brackets disposed on said lower surface of said support member;

(c) a connecting arm having a proximate end and a distal end, said distal end pivotally coupled to said brackets (d) an armrest attachment member pivotally coupled to said proximate end of said connecting arm, wherein the pivot axis of said distal end is perpendicular to the pivot axis of said proximate end; and (e) means for mounting said armrest attachment member onto the armrest of a chair.

14. An apparatus as recited in claim 13, further comprising a mousepad affixed onto said upper surface of said support member.

15. An apparatus as recited in claim 13, further comprising;

(a) a slot laterally disposed therethrough each said bracket;

(b) a first bolt passing through said distal end of said connecting arm and said slots of said brackets; and (c) a first nut threaded onto said first bolt, whereby said brackets are secured against said connecting arm.

16. An apparatus as recited in claim 15, further comprising;

(a) a second bolt passing laterally through said attachment member and said proximate end of said connecting arm;

(b) a pair of spacers, each said spacer disposed adjacent said proximate end of said connecting arm; and (c) a second nut threaded into said second bolt, whereby said spacers are secured against said connecting arm.

17. An apparatus as recited in claim 13, wherein said means for mounting said armrest attachment member comprises a plurality of straps extending from said armrest attachment member, said straps adapted to securely fasten said attachment member onto the armrest of a chair.

18. An apparatus as recited in claim 17, wherein said means for mounting said armrest attachment member further comprises at least one set screw.

19. An apparatus as recited in claim 13, further comprising padded material disposed on said armrest attachment member.

* * * * *